US009279336B2

(12) United States Patent
Warren

(10) Patent No.: US 9,279,336 B2
(45) Date of Patent: Mar. 8, 2016

(54) HIGH TEMPERATURE SPLIT-FACE PROBE

(75) Inventor: Eli Cole Warren, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 689 days.

(21) Appl. No.: 13/603,483

(22) Filed: Sep. 5, 2012

(65) Prior Publication Data

US 2014/0064926 A1 Mar. 6, 2014

(51) Int. Cl.

| | |
|---|---|
| ***F01D 17/02*** | (2006.01) |
| ***F01D 11/20*** | (2006.01) |
| ***F01D 17/06*** | (2006.01) |
| ***F01D 21/00*** | (2006.01) |

(52) U.S. Cl.
CPC ..... *F01D 11/20* (2013.01); *F01D 17/06* (2013.01); *F01D 21/003* (2013.01)

(58) Field of Classification Search
CPC ... F01D 17/02; F01D 21/003; F05D 2260/80; F05D 2270/114
USPC ..... 73/112.01
See application file for complete search history.

(56) References Cited

U.S. PATENT DOCUMENTS

| | | | | |
|---|---|---|---|---|
| 4,122,708 | A | 10/1978 | Maier | |
| 5,101,165 | A | 3/1992 | Rickards | |
| 5,122,755 | A | 6/1992 | Nootbaar et al. | |
| 5,166,626 | A * | 11/1992 | Hester et al. | 324/690 |
| 5,315,884 | A | 5/1994 | Kronberg | |
| 5,760,593 | A * | 6/1998 | Lawrence et al. | 324/662 |
| 6,692,222 | B2 | 2/2004 | Prinz et al. | |
| 2005/0287386 | A1 * | 12/2005 | Sabol et al. | 428/543 |
| 2007/0128016 | A1 * | 6/2007 | Dasgupta et al. | 415/14 |
| 2008/0072681 | A1 | 3/2008 | Ruud et al. | |
| 2009/0003991 | A1 * | 1/2009 | Andarawis et al. | 415/118 |
| 2009/0177433 | A1 * | 7/2009 | Palmer et al. | 702/145 |
| 2011/0006791 | A1 * | 1/2011 | Schneider et al. | 324/690 |

* cited by examiner

*Primary Examiner* — Dwayne J White
*Assistant Examiner* — Joshua R Beebe
(74) *Attorney, Agent, or Firm* — Carlson, Gaskey & Olds, P.C.

(57) ABSTRACT

An example split-face probe includes a sensor component having a split-face, a housing arranged about the sensor component, and at least one ceramic fitting that supports the sensor component.

18 Claims, 4 Drawing Sheets

HIGH TEMPERATURE SPLIT-FACE PROBE

BACKGROUND

This disclosure relates generally to a measurement probe and, more particularly, to a split-face capacitance probe used in high temperature environments, such as environments having temperatures above 400° F.

Turbomachines, such as gas turbine engines, typically include a fan section, a compression section, a combustion section, and a turbine section. Turbomachines may employ a geared architecture connecting portions of the compression section to the fan section.

The turbomachine may include an annular case structure that circumscribes a rotatable array of blades. Tip-timing probes mounted to the case can be used to monitor vibratory stresses within the blades. Tip clearance probes detect tip clearance to the blades. Split-face capacitance probes with circuit boards have been used in areas of the turbomachine having a relatively low temperatures, such as temperatures at or below 400° F. (204° C.). These probes may become damaged if used in other, higher temperature environments of the engine.

SUMMARY

A split-face probe according to an exemplary aspect of the present disclosure includes, among other things, a sensor component having a split-face. A housing is arranged about the sensor component. At least one ceramic fitting supports the sensor component.

In a further nonlimiting embodiment of the foregoing split-face probe, the sensor is configured for use at temperatures above 400° F.

In a further nonlimiting embodiment of either of the foregoing split-face probes, the sensor component may include individual sensors separated from each other by a portion of the at least one ceramic fitting.

In a further nonlimiting embodiment of any of the foregoing split-face probes, the portion of the at least one ceramic fitting bisects the split-face.

In a further nonlimiting embodiment of any of the foregoing split-face probes, the at least one ceramic fitting includes an upper ceramic, a lower ceramic, and a portion of the sensor component sandwiched therebetween.

In a further nonlimiting embodiment of any of the foregoing split-face probes, at least one strap electrically couples the sensor component to a hard lead. The at least one strap is sandwiched between the sensor component and the upper ceramic.

In a further nonlimiting embodiment of any of the foregoing split-face probes, the sensor component is supported exclusively by the at least one ceramic fitting.

In a further nonlimiting embodiment of any of the foregoing split-face probes, the sensor component is a capacitance-based sensor component.

In a further nonlimiting embodiment of any of the foregoing split-face probes, the at least one ceramic fitting circumscribes the split-face.

In a further nonlimiting embodiment of any of the foregoing split-face probes, the at least one ceramic fitting comprises aluminum oxide.

A method of detecting a blade-related measurement includes supporting a split-face sensor component with at least one ceramic fitting.

In a further nonlimiting embodiment of the foregoing method of detecting, the split-face sensor component is configured for operation in environments having temperatures exceeding 400° F.

In a further nonlimiting embodiment of either of the foregoing methods of detecting, the split-face sensor component comprises a capacitance sensor.

In a further nonlimiting embodiment of any of the foregoing methods of detecting, the split-face sensor component is configured to detect the time of arrival of a turbomachine blade tip.

A turbomachine according to another exemplary aspect of the present disclosure includes, among other things, a gas path having a plurality of rotors and stators. A probe is configured to detect a turbomachine blade-related measurement. The probe includes a sensor component having a split-face, a housing arranged about the sensor component, and at least one ceramic fitting that supports the sensor component.

In a further nonlimiting embodiment of the foregoing turbomachine, the sensor component is configured for use at temperatures above 400° F.

In a further nonlimiting embodiment of either of the foregoing turbomachines, the sensor component includes individual sensors separated from each other by portion of the at least one ceramic fitting.

In a further nonlimiting embodiment of any of the foregoing turbomachines, the portion of the at least one ceramic fitting bisects the split-face.

In a further nonlimiting embodiment of any of the foregoing turbomachines, the sensor component is a capacitance-based sensor component.

In a further nonlimiting embodiment of any of the foregoing turbomachines, the at least one ceramic fitting circumscribes the split-face.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
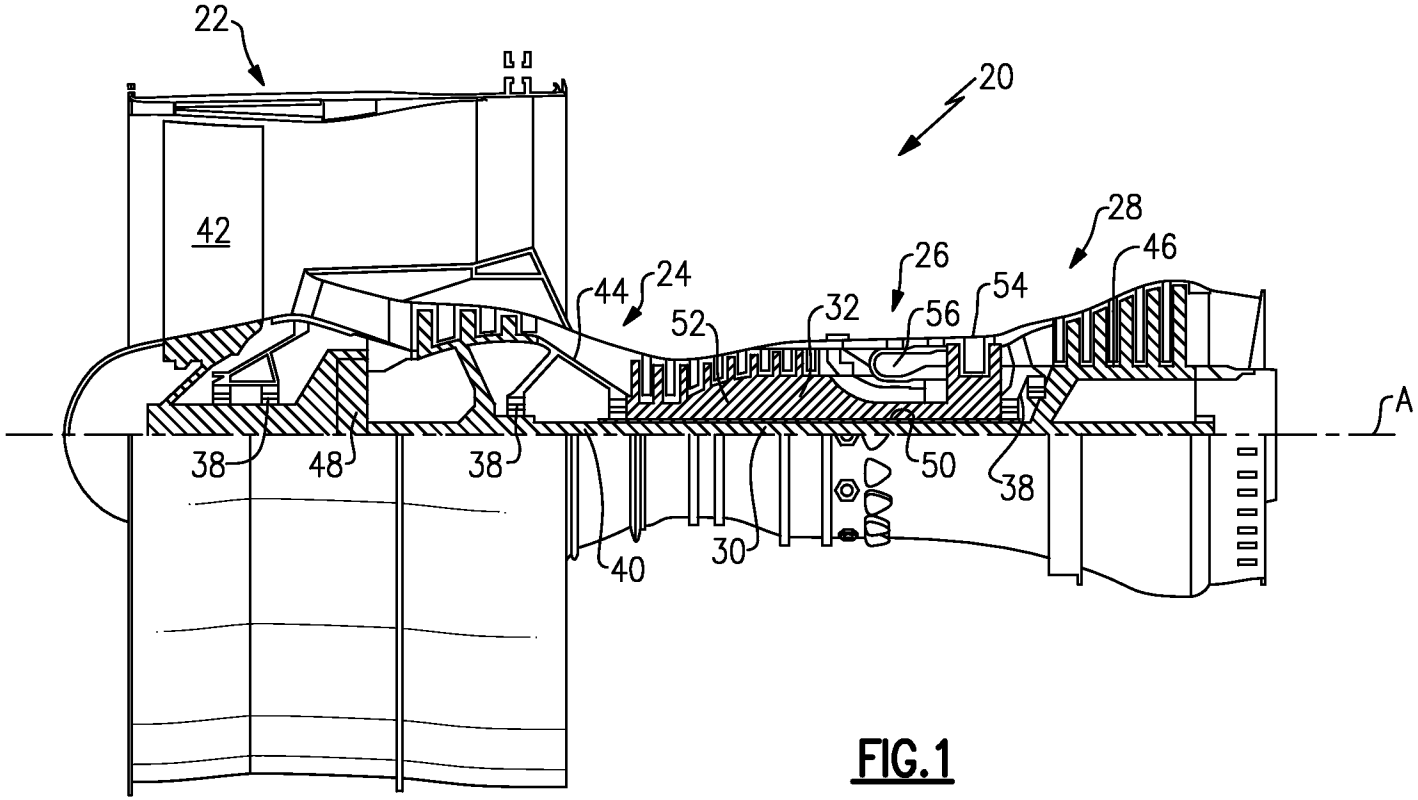
FIG. 1 shows an example turbomachine.
Figure 2:
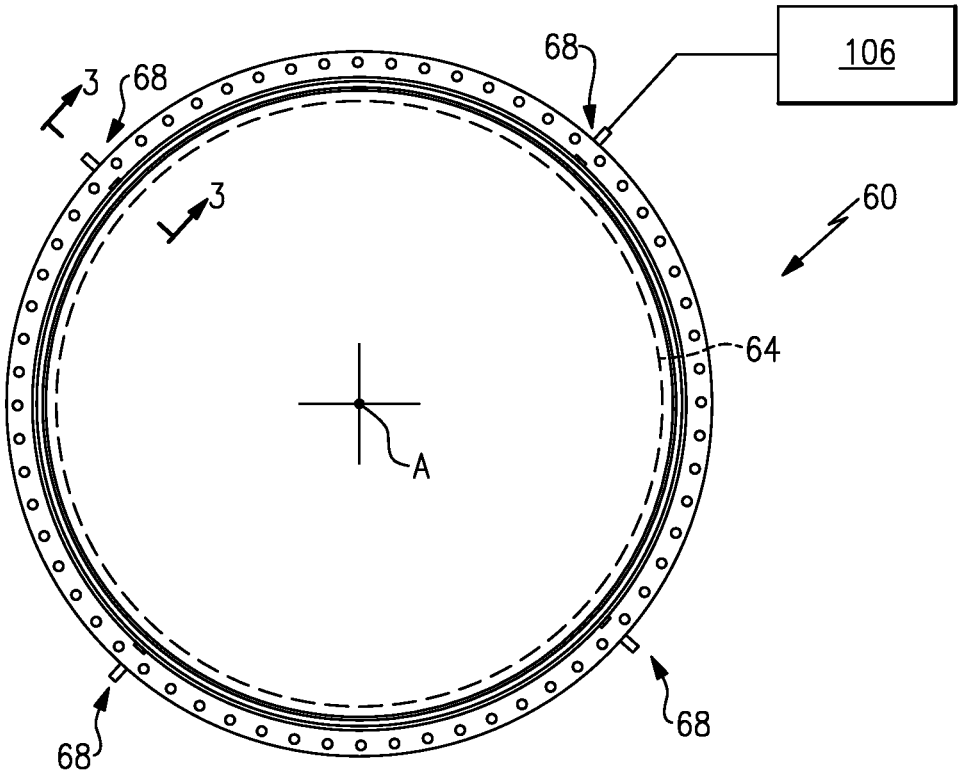
FIG. 2 shows an aft view of a compressor case of the turbomachine of FIG. 1.
Figure 4:
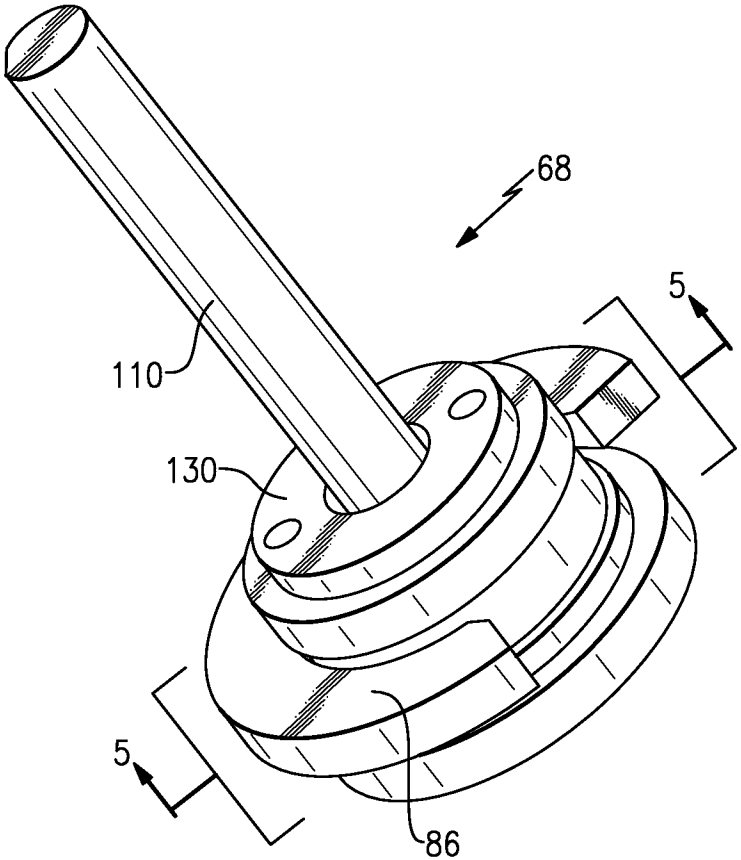
FIG. 4 shows another perspective view of the split-face probe of FIG. 3.
Figure 3:
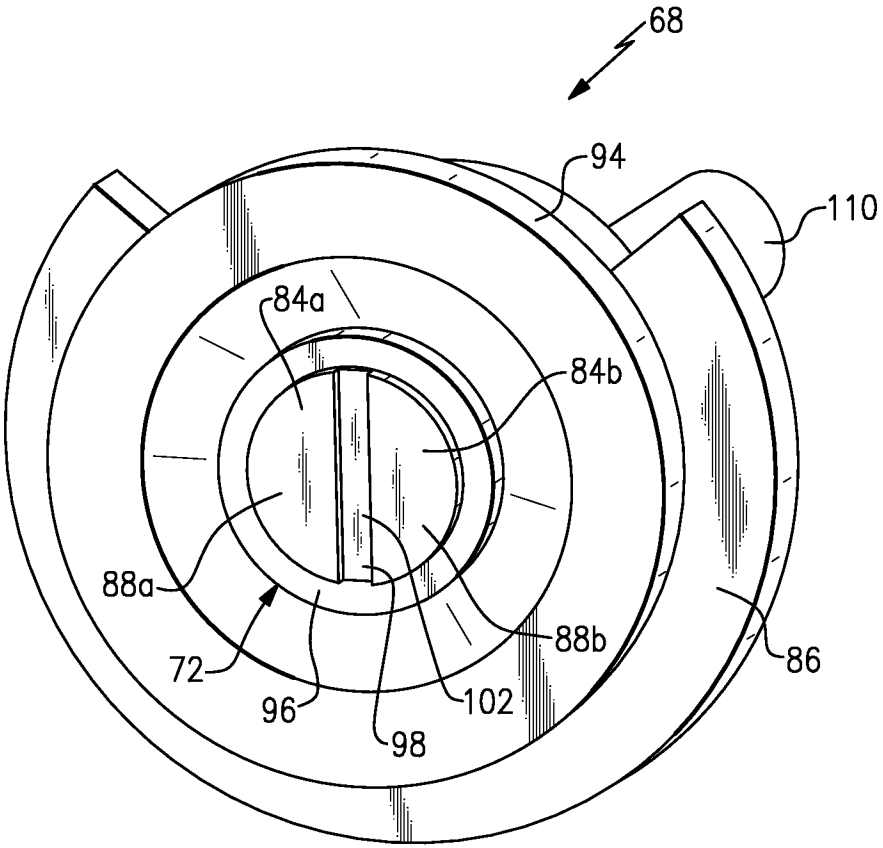
FIG. 3 shows perspective view of a split-face probe held within the case of FIG. 2.
Figure 5:
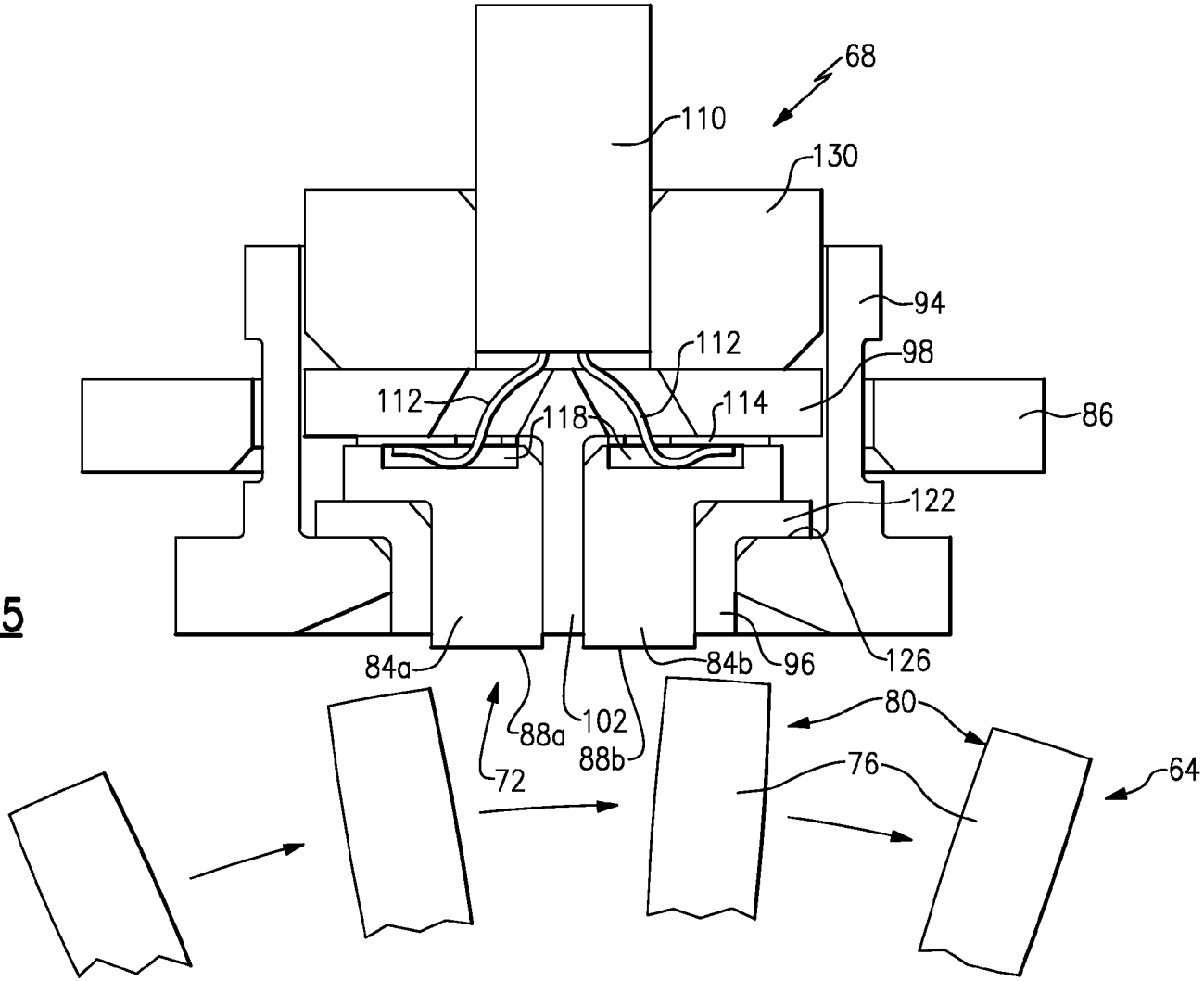
FIG. 5 shows a section view at line 5-5 in FIG. 4.

FIG. 1 schematically illustrates an example turbomachine, which is a gas turbine engine 20 in this example. The gas turbine engine 20 is a two-spool turbofan gas turbine engine that generally includes a fan section 22, a compression section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures. Further, the concepts described herein could be used in environments other than a turbomachine environment and in applications other than aerospace applications.

In the example engine 20, flow moves from the fan section 22 to a bypass flowpath. Flow from the bypass flowpath generates forward thrust. The compression section 24 drives air along the core flowpath. Compressed air from the compression section 24 communicates through the combustion section 26. The products of combustion expand through the turbine section 28.

The example engine 20 generally includes a low-speed spool 30 and a high-speed spool 32 mounted for rotation about an engine central axis A. The low-speed spool 30 and the high-speed spool 32 are rotatably supported by several bearing systems 38. It should be understood that various bearing systems 38 at various locations may alternatively, or additionally, be provided.

The low-speed spool 30 generally includes a shaft 40 that interconnects a fan 42, a low-pressure compressor 44, and a low-pressure turbine 46. The shaft 40 is connected to the fan 42 through a geared architecture 48 to drive the fan 42 at a lower speed than the low-speed spool 30.

The high-speed spool 32 includes a shaft 50 that interconnects a high-pressure compressor 52 and high-pressure turbine 54.

The shaft 40 and the shaft 50 are concentric and rotate via bearing systems 38 about the engine central longitudinal axis A, which is collinear with the longitudinal axes of the shaft 40 and the shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. The Temperature represents the ambient temperature in degrees Rankine. The Low Corrected Fan Tip Speed according to one non-limiting embodiment of the example engine 20 is less than about 1150 fps (351 m/s).

Referring now to FIGS. 2 to 5 with continuing reference to FIG. 1, an example case is a compressor case 60 from the high-pressure compressor section 52 of the engine 20. The compressor case 60 circumscribes a compressor blade array 64. For clarity, the compressor blade array 64 is shown in broken line form in FIG. 2.

The compressor case 60 includes several split-face probes 68 that include sensor components 72. The example probes 68 are measurement probes used to measure blade-related measurements. For example, the probes 68 may measure the time of arrival and thereby deflection and stress of blades 76 of the array 64. Specifically, the probes 68 may measure a circumferential position of tips 80 of the blades 76 as the array 64 is rotated relative to the probes 68 during operation of the engine 20. The actual circumferential position of the tips 80 is compared to a predicted position of the tips 80 to determine deflection of the blades 76, which may help indicate stress on the blades 76.

The example sensor component 72 of the probe 68 is a metallic capacitance-based sensor. The sensor component 72 includes a first sensor 84*a* having a hemispherical sensor face 88*a*, and a second sensor 84*b* having a hemispherical sensor face 88*b*. A housing 94 is arranged about the first and second sensors 84*a* and 84*b*. A retaining member 86 member 90 may be used to hold the probe 68 to the case compressor 60.

The probes 68 may be dual-measurement probes that also measure radial clearance between the tips 80 of the blades 76 and the sensor faces 88*a* and 88*b*. Clearance is the radial distance between the tips 80 and the faces 88*a* and 88*b* and can be detected by changes in amplitude of a signal from the sensor component 72.

The sensors 84*a* and 84*b* are reversed in polarity and sandwiched radially between a first ceramic fitting 96 and a second ceramic fitting 98 within the housing 94. The first example ceramic fitting 96 is a lower ceramic that circumscribes a portion of the sensor component 72.

The second ceramic fitting 98 is an upper ceramic in this example. The second ceramic fitting 98 includes a flange 102 that extends radially between the first sensor 84*a* and a second sensor 84*b*. The flange 102 bisects the hemispherical sensor faces 88*a* and 88*b*. The flange 102 provides a zero-crossing voltage signal. Tip-timing is typically the circumferential time-of-arrival and can be extracted from the time of the zero-crossing of the signal.

The first sensor 84*a* and 84*b* are operably coupled to a controller 106 through a hard lead 110, conductor wires 112, and straps 114. These components help connect the split-face probe 68 to a capacitance to voltage converter circuit. The controller 106 may include a signal conditioner.

The first and second sensors 84*a* and 84*b* include a groove 118 that accommodate portions of the conductor wires 112. Sandwiching the sensors 84*a* and 84*b* between the first ceramic fitting 96 and the second ceramic fitting 98 urges the conductor wires 112 against the straps 114, which operably connects the first and second sensors 84*a* and 84*b* to the hard lead 110.

The first ceramic fitting 96 includes an annular flange 122 that rests against a shoulder 126 of the housing 94 to limit radially inward movement of the first ceramic fitting 96. A cap

130 may be welded, press- or interference-fit into the housing 94 to limit radially outward movement of the second ceramic fitting 98.

In this example, exclusively the first ceramic fitting 96 and the second ceramic fitting 98 support the sensors 84*a* and 84*b*. The first ceramic fitting 96 and the second ceramic fitting 98 also electrically isolate and insulate the sensors 84*a* and 84*b*, from the housing 94, the cap 130, the retaining member 86 (which all may be steel).

In this example, the first ceramic fitting 96 and the second ceramic fitting 98 are both aluminum oxide (or alumina) material, such as a 99.5 percent pure $Al_2O_3$.

Features of the disclosed examples include a split-face probe that is suitable for use at temperatures above 400° F. and as high as 1400° F. The split-face probes in the prior art includes circuit board material, which can become damaged at such temperatures.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A split-face probe comprising:

a sensor component having a split-face;

a housing arranged about the sensor component; and at least one ceramic fitting that supports the sensor component and circumscribes the split-face, wherein the at least one ceramic fitting is electrically non-conductive.

2. The probe of claim 1, wherein the sensor is configured for use at temperatures above 400 degrees Fahrenheit.

3. The probe of claim 1, wherein the sensor component includes individual sensors having sensing faces that are configured to face outwardly from the split-face probe toward a blade array, the sensing faces completely separated from each other by a portion of the at least one ceramic fitting.

4. The probe of claim 3, wherein the portion of the at least one ceramic fitting bisects the split-face.

5. The probe of claim 1, wherein the at least one ceramic fitting includes an upper ceramic, a lower ceramic, and a portion of the sensor component sandwiched therebetween.

6. The probe of claim 5, including at least one strap that electrically couples each sensor component to a hard lead, at least one strap sandwiched between the sensor component and the upper ceramic.

7. The probe of claim 1, wherein the sensor component is supported exclusively by the at least one ceramic fitting.

8. The probe of claim 1, wherein the individual sensors each include a sensing face, wherein the sensing face of each of the individual sensors is separated from the sensing face of the other individual sensors by the at least one ceramic fitting.

9. The probe of claim 1, wherein the split-face is separated by the portion of the at least one ceramic fitting into two separate and distinct semi-circular sensing faces that are completely separated from each other by the portion of the at least one ceramic fitting.

10. A method for detecting a blade related measurement comprising:

Supporting a split-face sensor component with at least one ceramic fitting,

Said fitting circumscribes the split-face, wherein the at least one ceramic fitting is electrically non-conductive.

11. The method of claim 10, wherein the split-face sensor component is configured for operation in environments having temperatures exceeding 400 degrees Fahrenheit.

12. The method of claim 10, wherein the split-face sensor component is configured to detect a turbomachine blade tip.

13. The method of claim 10, wherein the split-face includes at least two sensing faces spaced from each other by a portion of the at least one ceramic fitting.

14. A turbomachine comprising:

a gas path including a plurality of rotors and stators; and a probe configured to detect a turbomachine blade-related measurement, the probe comprising, a sensor component having a split-face, a housing arranged about the sensor component, at least one ceramic fitting that supports the sensor component and circumscribes the split-face, wherein the at least one ceramic fitting is electrically non-conductive.

15. The turbomachine of claim 14, wherein the sensor component is configured for use at temperatures above 400 degrees Fahrenheit.

16. The turbomachine of claim 14, wherein the sensor component includes individual sensors that each have one of a plurality of forward facing sensing faces, the plurality of forward facing sensor faces are each completely separated from each other by a portion of the at least one ceramic fitting.

17. The turbomachine of claim 14, wherein the portion of the at least one ceramic fitting bisects the split-face.

18. The turbomachine of claim 14, wherein the split-face comprises two front sensing faces completely separated and spaced from each other by a portion of the at least one ceramic fitting.

* * * * *